United States Patent [19]

dePolo

[11] 4,400,032

[45] Aug. 23, 1983

[54] ECCENTRICALLY ROTATABLE CHAIR

[76] Inventor: Harry R. dePolo, 480 Park Ave., New York, N.Y. 10021

[21] Appl. No.: 95,450

[22] Filed: Nov. 19, 1979

Related U.S. Application Data

[63] Continuation-in-part of Ser. No. 893,685, Apr. 5, 1978, abandoned.

[51] Int. Cl.[3] ..... A47C 3/18

[52] U.S. Cl. ..... 297/349; 297/291; 248/416

[58] Field of Search ..... 297/349, 241, 142, 383, 297/291; 248/416, 425, 429, 188.2; 108/140

[56] References Cited

U.S. PATENT DOCUMENTS

| | | | |
|---|---|---|---|
| 693,685 | 2/1902 | Case | 297/383 |
| 937,625 | 10/1909 | Mead | 297/241 |
| 2,024,045 | 12/1935 | Johnson | 297/142 |
| 2,034,509 | 3/1936 | DeHaven | 16/26 |
| 2,212,777 | 8/1940 | Jones et al. | 297/241 |
| 2,449,385 | 9/1948 | Johnson et al. | 297/241 |
| 2,557,232 | 6/1951 | Morgan | 297/241 |
| 3,186,761 | 6/1965 | Propst | 297/349 |
| 4,023,760 | 5/1977 | Robinson | 248/188.2 |

FOREIGN PATENT DOCUMENTS

| | | | |
|---|---|---|---|
| 260053 | 7/1949 | Switzerland | 297/291 |

*Primary Examiner*—Francis K. Zugel

*Attorney, Agent, or Firm*—Robert E. Burns; Emmanuel J. Lobato; Bruce L. Adams

[57] ABSTRACT

A chair for business or home use comprises a rotatable seat supported on a single leg at the bottom of which is a ball bearing caster. The leg is connected by a telescopically extensible arm to a pivot post which projects upwardly from the center of a circular base plate on which the ball bearing caster is adapted to roll as the chair swings around the pivot post. The chair may also have a back rest which is mounted for universal movement on a back support which extends rearwardly from an upper portion of the chair leg and then upwardly. The ball bearing caster comprises a larger ball retained in a socket and resting on a circle of smaller bearing balls so that the larger ball can rotate freely in all directions. Alternatively the ball bearing caster comprises a plurality of balls in a retainer.

19 Claims, 22 Drawing Figures

ECCENTRICALLY ROTATABLE CHAIR

REFERENCE TO PRIOR APPLICATION

This application is a continuation-in-part of my application Ser. No. 893,685, filed Apr. 5, 1978, now abandoned.

FIELD OF INVENTION

The present invention relates to chairs for business and home use and particularly chairs which are mounted for movement eccentrically on a base. The term "chair" is herein used in a generic sense to include stools and other seating devices.

BACKGROUND OF THE INVENTION

Office chairs are customarily supported on four casters each of which comprises a small wheel mounted eccentrically on a spindle. When the chair is moved from one position to another, the caster wheels swing about the spindle axes into alignment with the direction of movement and roll along the floor. If the floor is carpeted, the chair is more difficult to move especially when someone is sitting in the chair and the repeated swinging and rolling movement of the casters soon wears through the floor covering. In order to protect the floor covering, boards of fiber or plastic are provided underneath the chairs. However, these are unsightly and interfere with cleaning. Most stools such as those used for example in drafting offices and most chairs used in the home are not provided with casters. They hence must ordinarily be lifted in order to be moved from one position to another. They can be slid along the floor only with difficulty and with resultant wear of the floor covering. For example when a person wishes to move up to or away from a table he usually moves his chair by a series of jerking, sliding movements. This is hard on the person, the chair and the floor.

SUMMARY OF THE INVENTION

It is an object of the present invention to provide a chair which is very comfortable and which is easily movable from one position to another. In accordance with the invention the chair seat is rotatably mounted on a single leg or column which is provided at its lower end with a special caster and is connected by a horizontal arm with a central pivot post on a circular base plate. The arm holds the leg upright and permits easy movement of the chair by swinging about the pivot post while the special caster rolls on the base plate. Moreover, the arm is telescopically extensible to permit movement of the chair seat and the leg supporting it toward and away from the pivot post. The special caster at the lower end of the leg comprises a single support ball which bears on a ring of small bearing balls so that it can rotate freely in any direction.

Moreover, the chair may be provided with a back rest which is mounted on a back support by a spring loaded ball and socket arrangement which permits universal movement of the chair back. The ball and socket arrangement by which the backrest is supported is similar to the caster at the lower end of the chair leg in that it comprises a larger ball which bears on a ball bearing comprising a ring of small bearing balls.

Chairs in accordance with the present invention may take a variety of forms. They may for example be office chairs with a seat and backrest and with or without arms. They may be stools provided with a footrest but without arms or back. They may be chairs suitable for use in the home for example as dining chairs, easy chairs or occasional chairs. The chairs in accordance with the invention may thus be in many shapes and sizes.

BRIEF DESCRIPTION OF DRAWINGS

The nature, objects and advantages of the invention will be more fully understood from the following description of preferred embodiments shown by way of example in the accompanying drawings in which:

FIG. 18 is a side elevation of another chair having a back but no arms;

FIG. 19 is an enlarged vertical partial section taken on the line 19—19 in FIG. 20;

FIG. 20 is a plan view of a lower part of the chair of FIG. 18; and

FIG. 21 is a vertical section taken on the line 21—21 in FIG. 20.

DESCRIPTION OF PREFERRED EMBODIMENTS

Figures 1, 1A, 11:
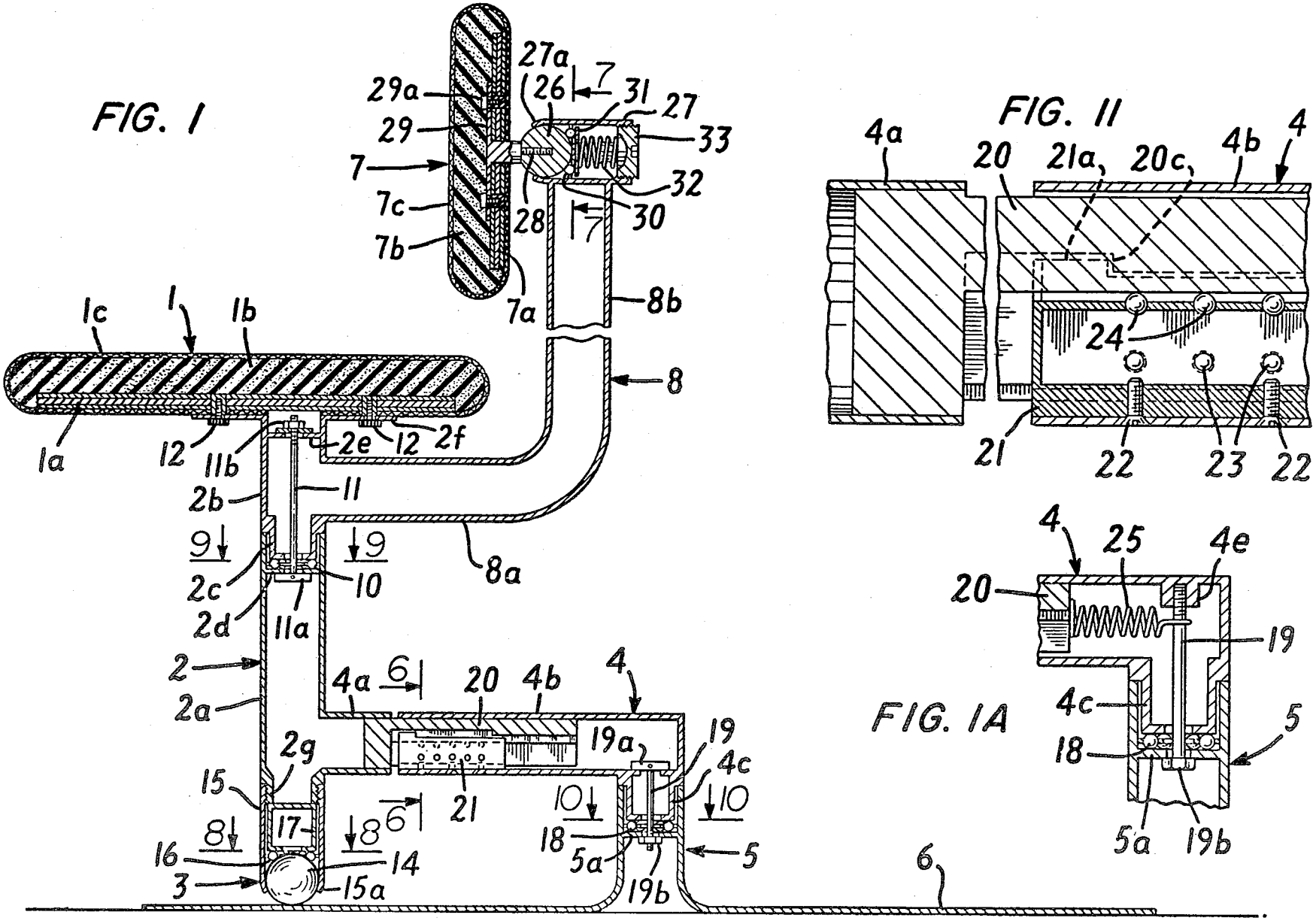
FIG. 1 is a full section elevational view of a chair in accordance with the present invention.
FIG. 1A is a partial sectional view similar to FIG. 1 but illustrating a modification.
FIG. 11 is a longitudinally section of a portion of the horizontal arm taken approximately on the line 11—11 in FIG. 6.
Figure 5:
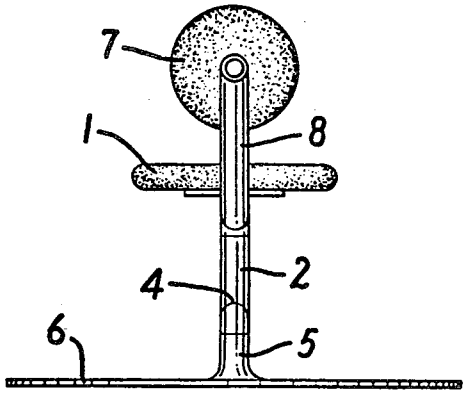
FIG. 5 is a rear view of the chair.
Figure 4:
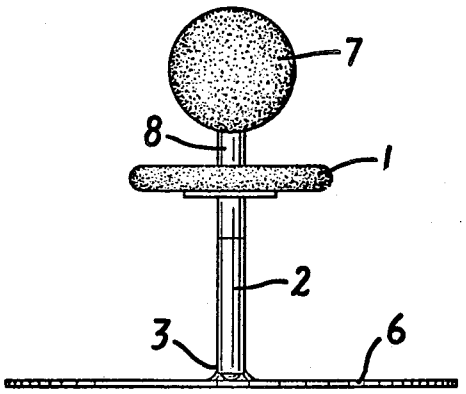
FIG. 4 is a front view of the chair.
Figure 3:
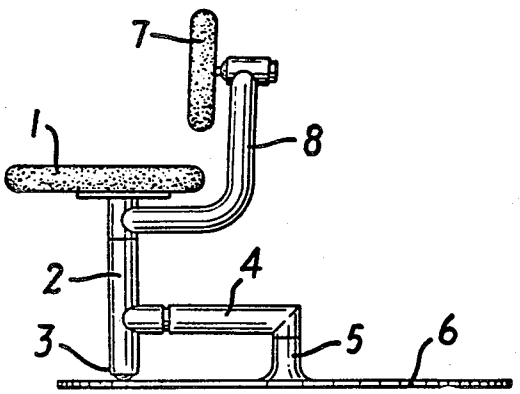
FIG. 3 is a side view on a smaller scale of the chair shown in FIG. 1.

A chair in accordance with the invention as shown by way of example in FIGS. 1–11 comprises a seat 1 supported by a single leg or column 2 having at its lower end a caster 3. The leg 1 is connected by an arm 4 with a central pivot post 5 of a circular base plate 6 on which the caster 3 rests. The arm 4 is swingable about the pivot post 5 so that the chair seat 1 and leg 2 move in an orbital path about the axis of the pivot post while the caster 3 rolls on the base plate 6. The chair is shown as having a backrest 7 mounted for universal movement on a back support 8.

The leg or column 2 comprises a main portion **2*a* and an upper portion 2*b* having at its lower end a cup-shaped reduced portion 2*c* which is rotatably received in the upper end of the main portion 2***a*. A ball bearing 10 comprising a ring of bearing balls in a suitable retainer is interposed between the lower end of the cup-shaped portion 2*c* and an internal flange 2*d* in the main portion 2*a* of the leg so as to support the upper leg portion 2*b* for free rotation. The upper portion 2*b* of the leg is retained on the main portion 2*a* by a bolt 11 having a pivot head 11*a* below the flange and a washer and nut 11*b* above an internal flange 2*e* in the upper leg portion 2*b*. The nut on the bolt 11 is tightened only sufficiently to hold the two leg portions in assembled relation without interfering with free rotation of the upper leg portion 2*b* on the main leg portion 2*a*.

The seat 1 comprises a base plate 1*a* formed, for example of plywood, a cushion 1*b*, for example of foam rubber or plastic, and a cover 1*c* of fabric or flexible sheet plastic which covers the cushion 1*b* and extends beneath the base plate 1*a*. The seat 1 rests on a flange 2*f* provided at the upper end of the upper leg portion 2*b* and is secured in place by screws 12 which extend through holes in the flange 2*f* and are screwed into the base plate 1*a* of the seat. A lower edge of the cover 1*c* is clamped between the flange 2*f* and the base plate 1*a* of the seat thereby further holding the cover. It will be understood that by reason of the seat 1 being mounted on the upper leg portion 2*b*, it is freely rotatable about the axis of the leg, the load of the seat and an occupant being taken by the ball bearing 10.

Figure 8:
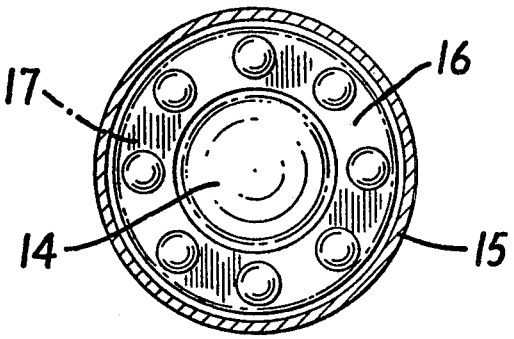
Figure 9:
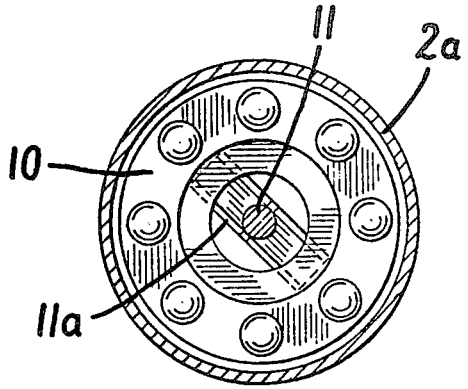
Figure 10:
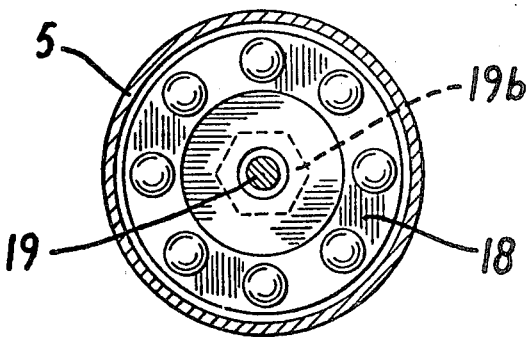

The caster 3 at the lower end of the leg 2 comprises a ball 14 received in a socket comprising a generally cylindrical sleeve 15, the internally threaded upper end of which is screwed onto an externally threaded reduced lower end portion 2*g* of the leg. The sleeve 15 has a restricted lower end portion 15*a* which retains the ball 14 in the sleeve while permitting a portion of the ball to project beyond the lower end of the sleeve as seen in FIG. 1. The ball 14 is supported by a ball bearing 16 which seats on the lower end of a hollow cylindrical spacer 17 that is received in the tubular sleeve 15 and abuts the lower end of the leg. The ball bearing 16 comprises a ring of small bearing balls received in a suitable retainer as seen in FIG. 8. The dimensions of the sleeve 15 and spacer 17 are selected so that the ball 14 protrudes below the lower end of the sleeve and is rotatable freely in all directions on the ball bearing 16 while being retained by the restricted lower end 15*a* of the sleeve. The ball 14 has a diameter slightly less than the inside diameter of the sleeve 15 and is formed of suitable hard durable material, for example metal or plastic. It may be either solid or hollow. As the chair swings about the central pivot post 5, the ball 14 rolls freely on the base plate 6.

The horizontal arm 4 comprises a tubular outer portion 4*a* which is fixed to the leg 2, for example by welding, and an inner portion 4*b* which is rotatably connected with the central pivot post 5 which projects up from the base plate 6. To provide such connection, the inner portion 4*b* of the arm 4 is provided with a downwardly projecting cylindrical portion 4*c* that is received in an upper portion of the pivot post 5. A ball bearing 18 comprising a ring of small bearing balls in a suitable retainer (FIG. 10) is interposed between the lower end of the cylindrical portion 4*c* and an internal flange 5*a* in the pivot post 5. The ball bearing 18 takes vertical loads of the arm 4 while permitting free rotation of the arm about the pivot post. The arm 4 is held in assembled relation with the base by a bolt 19 having a pivot head 19*a* inside the arm and a nut 19*b* below the flange 5*a*. The nut is tightened sufficiently to hold the arm in place while permitting free rotation on the ball bearing 18.

Figure 6:
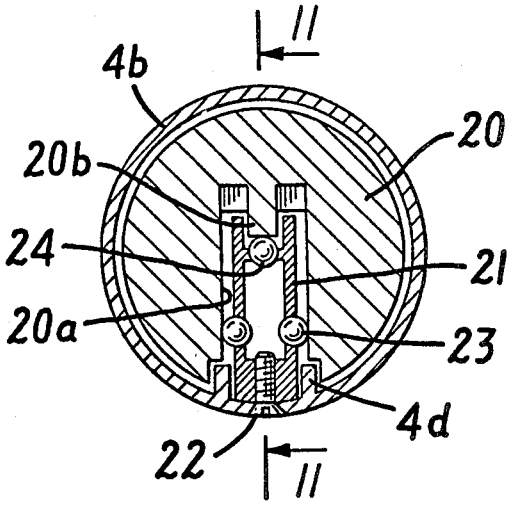
FIG. 6 is a cross sectional view of the horizontal arm of the chair taken approximately on the line 6—6 in FIG. 1.

The horizontal arm 4 is extensible by virtue of a telescopical connection between the outer portion 4*a* and the inner portion 4*b*. As seen in FIGS. 1, 6 and 11 such connection is provided by a slide 20 which is fixed at one end in outer arm portion 4*a* and extends slidably into inner arm portion 4*b*. The slide 20 is longitudinally slotted to receive a track 21 which is secured in inner arm portion 4*b* by screws 22. A plurality of bearing balls 23 in the sides of the track 21 engage opposite sides of the longitudinal slot 20*a* in slide 20 while other bearing balls 24 in a transverse portion of the track 21 engage a downwardly projecting rib portion 20*b* of the slide 20 to provide lateral and vertical guidance of the telescopic parts while permitting free movement of the outer arm portion 4*a* inwardly and outwardly with respect to the inner arm portion 4*b*. Movement of the chair toward and away from the central pivot post 5 is thereby permitted. For example a person seated at a desk can move backwardly away from the desk and then swing to the side in order to get up. Inward movement toward the central pivot post is limited by abutment of the end of outer arm portion 4*a* with the end of inner arm portion 4*b*. Outward movement is limited by engagement of an upwardly projecting portion 21*a* of the track 21 with a shoulder 20*c* of the slide 20 (see FIGS. 1 and 11). Further stability of the arm is provided by longitudinally extending internal ribs 4*d* in the inner arm portion 4*b* engaging opposite faces of an enlarged portion of the slot 20*a* in the slide 20.

If desired, the horizontal arm 4 can be spring biased for extension or contraction. For example as illustrated in FIG. 1A a light tension spring 25 is connected at one end to the slide 20 and is anchored at the other end by means of an eye or hook which receives the bolt 14 which anchors the arm 4 to the pivot post 5. In this case the bolt 14 is extended and screwed into an internally threaded lug 4*e* provided in the inner arm portion 4*b*. By virtue of the bias thus provided, the chair will automatically retract from an outer position to an inner position closer to the pivot post when unoccupied. Conversely the spring 25 may be a compression spring so as to tend to hold the chair in its outer position.

Figure 7:
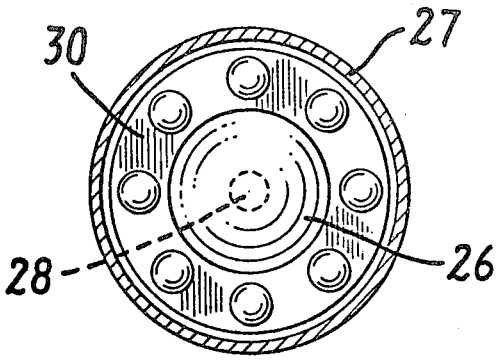
FIGS. 7, 8, 9 and 10 are cross sectional views taken approximately on the lines 7—7, 8—8, 9—9, and 10—10 respectively in FIG. 1.

As shown by way of example in FIGS. 1–5, the backrest 7 is circular and comprises a circular base plate 7*a*, for example of plywood, a cushion 7*b*, for example of foam rubber or plastic, and a cover 7*c* of for example flexible plastic or fabric. As seen in FIG. 1 the covering material 7*c* covers the front, edges and back of the backrest. The support 8 for the backrest is tubular and comprises a horizontal portion 8*a* which is fixed to the upper leg portion 2*b*, for example by welding, and extends rearwardly beyond the seat 1 and a generally vertical portion 8*b* which extends upwardly from the horizontal portion 8*a* a sufficient distance to support the backrest at an appropriate height. The backrest is mounted on the support 8 by a universal joint comprising a ball 26 received in a socket 27. The ball 26 has an internally threaded bore and is screwed onto a threaded stem 28 which extends rearwardly from a plate 29 secured to the back plate 7*a* of the backrest 7 by means of screws 30. While the plate 29 could be secured to the back of the backrest in a manner similar to the mounting of the seat 1, a neater appearance is provided by securing the plate 29 to the inner face of the back plate 7*a* before the cushion 7*b* and covering 7*c* are applied. The socket 27 comprises a generally cylindrical sleeve secured on the upper end of the back support 8, for example by welding. At its forward end 27*a*, the opening of the sleeve 27 is restricted so as to retain the ball 26 in the sleeve. A ball bearing 30 is pressed against the ball 26 by a washer 31 and spring 32 which acts between the washer and a plug 33 screwed into the internally threaded rear end portion of the sleeve 27. The ball 26 is thereby pressed into the restricted opening at the forward end of the sleeve 27 with the result that the backrest 7 can be tilted in any direction to a desired position and will thereupon be retained in that position by frictional engagement of the ball 26 with the restricted end portion of the sleeve 27. Moreover, the backrest 7 can be moved rearwardly against the pressure of the spring 32. As illustrated in FIG. 7, the bearing 30 comprises a circle of small bearing balls in a retainer which keeps the balls in proper circumferential position. The plug 33 can be screwed into the sleeve 27 a variable amount to vary the spring pressure on the ball 26. Preferably, however, the plug 33 protrudes slightly beyond the rear end of the sleeve 27 and is formed of plastic material, for example nylon so that it would not mar any wall surface which it may happen to engage.

Figure 2:
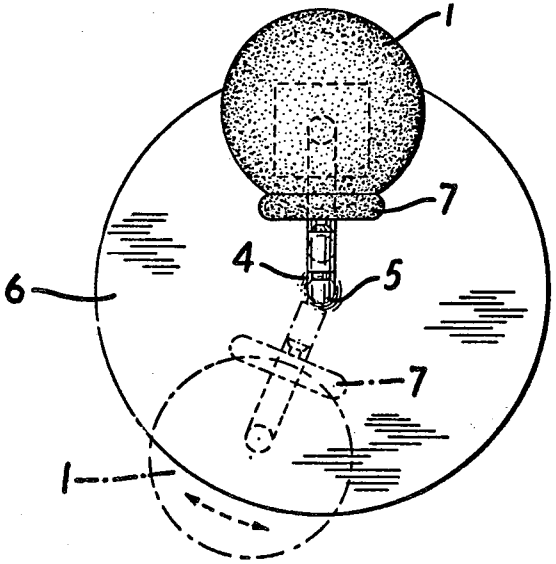
FIG. 2 is a schematic plan view on a smaller scale illustrating how the chair moves in a circular motion.

As illustrated in FIG. 2, the seat 1 can be swung around the pivot post 5 to any desired position. Moreover, as described above the seat may be moved inwardly toward or outwardly away from the pivot post 5 by an amount permitted by the telescopic interconnection of portions 4*a* and 4*b* of the horizontal arm 4. In movement of the seat to different positions, the ball 14 of the caster 3 rolls freely on the base plate 6 by reason of the ball bearing 16 through which the supporting ball 14 carries the weight of the seat and any occupant. Moreover, the seat 1 is freely rotatable on the leg 1 by virtue of the ball bearing 10 and the backrest 7 is mounted on the back support 8 in such manner as to permit universal movement of the backrest.

Figure 12:
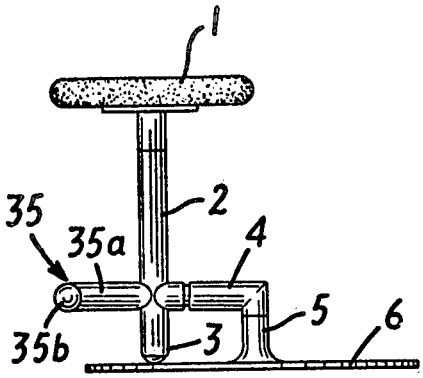
FIG. 12 is a side view of a stool in accordance with the invention having a foot rest but no arms or back.

Chairs in accordance with the invention may assume different configurations according to the uses for which they are intended. Several different configurations are illustrated by way of example in FIGS. 12 to 15. Thus for example in FIG. 12 there is shown a stool comprising a seat 1, leg 2, caster 3, horizontal arm 4, pivot post 5 and base plate 6 as described above. However, there is no back and hence no back support. On the other hand the stool is provided with a T-shaped footrest 35 comprising a tubular portion 35*a* which is affixed to and extends forwardly from the leg 2 and a transverse tubular portion 35*b* at the forward end of the portion 35*a*. As the footrest 35 is affixed to the leg 2, for example by welding, it is carried around with the seat 1 when swung about the pivot post 5.

Figure 13:
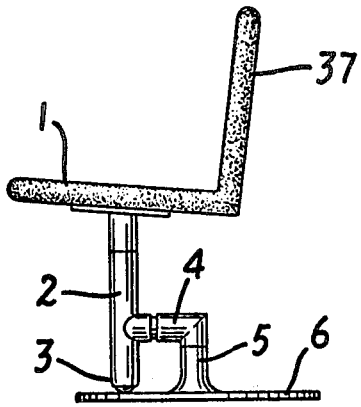
FIG. 13 is a side elevation of a chair having a back but no arms and usable for example as a dining chair.

In FIG. 13 there is shown a chair which is suitable for use as a side chair or dining chair. As in FIG. 1 it has a seat 1, leg 2, caster 3, arm 4, pivot post 5 and base plate 6. However, it will be noted that the seat 1, instead of being round is generally rectangular and is inclined slightly rearwardly. Moreover, the chair has an upholstered back 37 which is fixed to the rear of the seat 1. Moreover, the arm 4 is shorter and the base plate 6 is smaller than in FIG. 1.

Figure 14:
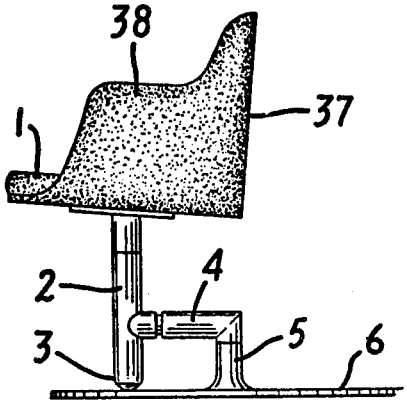
FIG. 14 is a side elevation of an arm chair usable for example as an office desk chair.

FIG. 14 shows an arm chair for use as an office desk chair or in the home. The chair shown in FIG. 14 is similar to that of FIG. 13 except that it has arms or sides 38 forming a unitary structure with the seat 1 and the back 37. Moreover, the arm 4 is somewhat longer and the base plate 6 corresponding larger.

Figure 15:
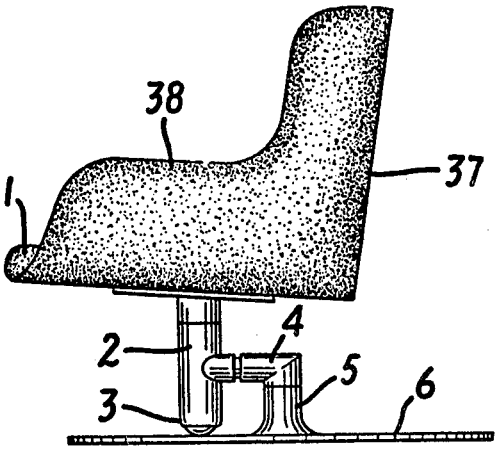
FIG. 15 is a side elevation of a loung chair also capable of office use.

In FIG. 15 there is shown a lounge chair suitable for use in the home and also in certain office applications such as in a conference room. The chair shown in FIG. 15 is generally similar to that of FIG. 14 but somewhat more massive.

Figure 16:
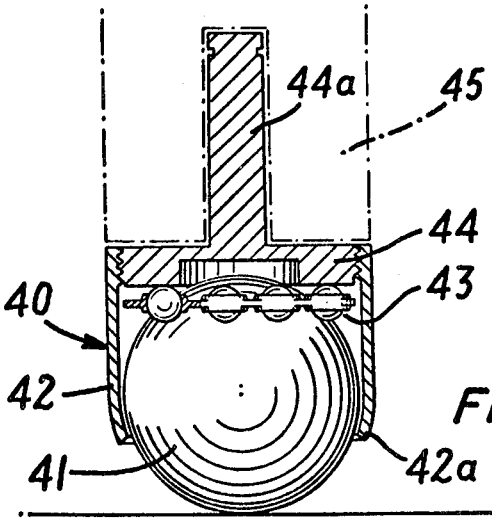
FIG. 16 is a sectional view illustrating a modification of the caster shown in FIG. 1.

In FIG. 16 there is shown a variation of the caster illustrated in FIG. 1. The caster 40 comprises a support ball 41 received in a socket 42 which is generally cylindrical but has a restricted lower end portion 42*a* to retain the ball in the socket. A ball bearing 43 is interposed between the ball 41 and a bearing plate 44 which is screwed into the internally threaded upper end portion of the socket 42. The ball 41 has a diameter slightly less than the internal diameter of the cylindrical portion of the socket 42 but greater than the restricted opening at the lower end of the socket so that the ball protrudes beyond the socket and is supported by the bearing 43 for free rotation in all directions. The bearing 43 is similar to the bearing 16 shown in FIGS. 1 and 8 and comprises a circle of small bearing balls in a suitable retainer. The bearing plate 44 is provided with a central upwardly projecting stem 44*a* adapted to be received in a bore provided in the lower end of a leg 45 which is shown in broken lines and may for example be the leg of a chair or table. The caster 40 can thus be mounted on furniture like an ordinary caster. However, the stem 44*a* does not rotate in the bore of the leg since, unlike an ordinary caster, the caster of the present invention does not need to swivel. Movement in all directions is provided by rotation of the support ball 41 on the ball bearing 43.

Figure 17:
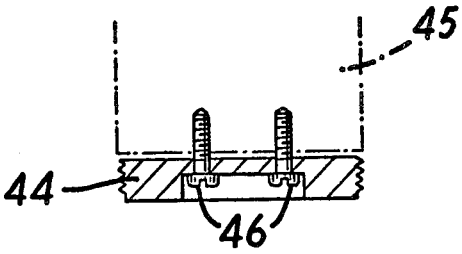
FIG. 17 is a sectional view illustrating a modification of the caster construction shown in FIG. 16.

A variation is illustrated in FIG. 17 where the bearing plate 44 does not have a stem portion but is provided with recessed screw holes so that it can be secured to a leg 45 or to the base of an article to be supported by means of screws 46. Otherwise the caster is of the same construction as is illustrated in FIG. 16.

A variety of materials can be used in construction of chairs in accordance with the present invention. Tubular portions such as the leg 2, arm 4, back support 8 and sleeves 15 and 27 are conveniently made of thin wall aluminium or magnesium tubing. However, alternatively, plastic tubing may also be used. The bearing balls are preferably steel while fittings such as bolts 11 and 19 may conveniently be steel or other metal. The support balls of the casters and ball 26 of the back mounting may be steel or other metal but are preferably high strength plastic, for example nylon. They are of sufficiently large diameter to take the loads imposed upon them without unduly high stress concentration. For example the support balls of the caster may have a diameter of the order of 1 to 4 inches, or larger.

In FIGS. 18–21 there is shown a chair of somewhat simplified construction having a seat and back rest but no arms. The chair comprises a main support member 50 having a lower horizontal arm portion 50*a*, an upright support portion 50*b* for supporting a seat 51 and an upper horizontal arm 50*c* and vertical portion 50*d* for supporting a back 52. The horizontal arm portion 50*a* is telescopically extendible and rotatable through 360° with respect to a central pivot post 53 which defines a vertical axis of rotation. The central pivot post 53 comprises a strong threaded stud 54 which extends through a central hole in a fitting 55 and is screwed into a circular bearing plate 56. The fitting 55 is secured to a base plate 57, for example by rivets 58. If it is not desired to move the chair from one location to another, the fitting 55 can be secured directly to the floor, for example by screws or bolts whereupon the floor serves as a base for the chair.

An elongated channel 59 secured to the lower side of the horizontal arm portion 50*a* of the main support member 50 has a horizontal web portion 59*a*, downwardly extending vertical portions 59*b* and in-turned flange portions 59*c*. The bearing plate 56 is received in the channel 59 between the web portion 59*a* and in-turned flange portions 59*c* as seen in FIG. 21. A ball bearing 60 comprising a plurality of balls 60*a* in an annular retainer 60*b* is interposed between the bearing plate 56 and the web portion 59*a* of the channel 59. A ball bearing 61 comprising a plurality of balls 61*a* in an annular retainer 61*b* is interposed between the bearing plate 56 and the in-turned flange portions 59*c* of the channel 59. The ball bearings 60 and 61 permit rotation of the main support member through 360° relative to the central pivot post.

Moreover, the elongate channel 59 permits movements of the main support member 50 relative to the central pivot post in a direction longitudinal of the horizontal arm portion 50*a* so that the upright portion 50*b* supporting the seat 51 can be moved closer to or farther away from the vertical axis of rotation. Such longitudinal movement is limited by stop bars 62 which are inserted into end portions of the channel 59 and secured by screws 63 which also secure channel 59 to the horizontal arm portion 50*a* of the main support member 50. Since the bearing plate 56 is rigid and is rigidly secured to the base, tilting or rocking of the arm portion 50*a* of the main support member 50 about a longitudinal axis is prevented. The support portion 50*b* of the main support member 50 is thereby held in an upright position.

At the lower end of the upright support portion 50*b* there is provided a single rolling support which takes vertical loads and thereby supports the support portion 50*b* and seat 51 together with the load imposed by the person sitting on the seat. The rolling support is shown as a ball bearing 65 comprising a plurality of balls 65*a* and an annular retainer 65*b*. The retainer is rotatably mounted on the lower side of the main support member 50 at the foot of the upright portion 50*b* by fittings 66 and 67 and a screw 68 which extend through a hole in the main support member. The balls 65*a* have rolling engagement with the lower face of the main support member 50 and with the base 57. Hence the retainer 65*b* does not take vertical loads but merely serves to position the balls. While the ball bearing 65 is shown as having eight balls, it will be understood that the number of balls can be varied.

The seat 51 is padded and has a central post 70 mounted in a fixture 71 at the upper end of the vertical support portion 50*b* of the main support member 50. If desired, the seat may be rotatable as for example in FIG. 1. Alternatively, it may be mounted non-rotatably since the entire chair is rotatable about the central axis defined by the pivot post 53. Preferably, however, it is vertically adjustable and can be fixed in selected vertical position by means of a knob 72.

The back 52 is padded and is mounted on an upper end portion of the main support member 50 by a universal mounting fixture 73 which is like that shown in FIG. 1. Moreover, the upper end portion of the main support member 50 is slotted as indicated at 50*e* to permit vertical adjustment of the back.

While the main support member 50 may be tubular, for example of rectangular cross section, it is shown as being a solid bar. It must be torsionally rigid so the mounting of the main support member on the central pivot post as described above keeps the chair upright. If the main support member is of suitable channel cross section, the additional channel member 59 may be unnecessary.

Although preferred embodiments of the invention have been illustrated in the drawings and are herein particularly described, it will be understood that many variations, modifications and adaptations of the invention are possible and that the invention is thus in no way limited to the illustrated embodiments.

What is claimed is:

1. A chair comprising a base, a central pivot post projecting up from said base and defining a vertical axis of rotation, said base extending 360° around said pivot post, an upright support member spaced radially from said axis, telescopically extendible means coupling said upright support member with said central pivot post for rotation of said upright support member about said axis through an angle of 360° by rotation of said coupling means about said pivot post, and for limited movement of said upright support member toward and away from said central pivot post by telescopic extension or contraction of said coupling means, while maintaining said upright support member in an upright position, said telescopically extendible coupling means comprising two relatively movable parts and antifriction means between said two parts to provide for free movement of said parts relative to one another, a seat mounted at the upper end of said upright member, and single rolling support means at the lower end of said upright support member and rolling on said base upon rotation of said upright support member about said central pivot post and upon movement of said upright support member toward or away from said central pivot post, said rolling support means being capable of rolling in all directions on said base and comprising antifriction bearing means at the lower end of said upright support member to support said upright support member and seat on said base, said upright support member being supported vertically solely by said single rolling support means and being maintained in an upright position by said telescopically extendible coupling means.

2. A chair according to claim 1, in which said rolling support means comprises annular antifriction ball bearing means at the lower end of said upright support member with its axis vertical, a single support ball adapted to roll on said base and rotatably engaging said antifriction ball bearing means and means laterally engaging said ball to retain it in alignment with said axis of said antifriction ball bearing means.

3. A chair according to claim 1, in which said upright support member comprises a main tubular portion to which said telescopically extendible means is fixed and a tubular stem portion rotatably mounted at the upper end of said main tubular portion and forming an upward extention thereof, said seat being fixed on said stem portion.

4. A chair according to claim 3, in which said tubular stem portion has a lower end rotatably received in an upper end portion of said main tubular portion of said upright support member to maintain said stem portion in axial alignment with said main member portion, and in which an antifriction thrust bearing is interposed between said stem portion and said main tubular portion to take the vertical load of said seat.

5. A chair according to claim 3, further comprising a back support extending radially and then upwardly from said stem portion and a chair back mounted on an upper end portion of said back support.

6. A chair according to claim 5, in which said chair back is mounted on said back support by mounting means providing universal movement of said chair back relative to said back support.

7. A chair according to claim 6, in which said mounting means comprises a ball fixed on the back of said chair back, a socket at the upper end of said back support receiving said ball and having a restricted opening to retain said ball in said socket, an antifriction bearing in said socket and spring means in said socket pressing said antifriction bearing against said ball to urge it toward said restricted opening of said socket.

8. A chair according to claim 1, in which said telescopically extendible means comprises an arm which is telescopically extendible within predetermined limits for movement of said upright support member and seat toward and away from said axis of rotation.

9. A chair according to claim 8, in which said arm comprises an outer portion fixed to said upright support member, an inner portion rotatably supported by said central pivot post, said inner and outer portions of said arm being telescopically movable relative to one another, and antifriction bearing means between said inner and outer portions of said arm providing for longitudinal movement of said arm portions relative to one another while preventing relative rotation of said outer and inner portions.

10. A chair according to claim 9, further comprising means for limiting longitudinal movement of said inner and outer portions of said arm relative to one another and spring means acting between said inner and outer portions of said arm throughout their movement within said limits to bias said inner and outer arm portions longitudinally relative to one another.

11. A chair according to claim 8, in which said central pivot post comprises a tubular pedestal projecting up from said base and in which said arm has at its inner end a cylindrical portion extending down into and rotatably received in said tubular pedestal.

12. A chair according to claim 11, further comprising antifriction bearing means between said pedestal and said cylindrical portion at the inner end of said arm.

13. A chair according to claim 1, further comprising a back support extending upwardly from said upright support member to a position above and rearwardly of said seat, a chair back, and means for mounting said chair back on said back support for universal movement of said chair back, said mounting means comprising a ball fixed on the back of said chair back, a socket at the upper end of said back support receiving said ball and having a restricted opening for retaining said ball in said socket, an antifriction bearing in said socket and spring means in said socket pressing said antifriction bearing against said ball to urge it toward said restricted opening of said socket.

14. A chair according to claim 13, further comprising a shaft supporting said seat for rotation about a vertical axis, said back support being fixed to said shaft below said seat.

15. A chair according to claim 13, in which said antifriction bearing comprises a bearing seat against which said spring means acts and a ball bearing between said seat and said ball fixed to the back of said chair back, said ball bearing comprising a ring of bearing balls and means retaining said bearing balls in a ring.

16. A chair according to claim 1, in which said rolling support means comprises a tubular socket on the lower end of said upright support member, said socket having at its lower end a restricted opening, a support ball rotatably received in said socket, said ball projecting partially out through said restricted opening but having a diameter larger than the diameter of said restricted opening so that said ball is retained in said socket, a bearing seat in said socket spaced from said restricted opening, said antifriction bearing means comprising a ball bearing interposed between said bearing seat and said support ball, said bearing seat and ball bearing being positioned to hold said support ball in a position in which it projects partially out through said restricted opening of said socket, said ball bearing comprising a ring of bearing balls and means for retaining said bearing balls in a ring, and means for securing said socket to said upright support member, with said restricted opening downwardly and said support ball resting on said base, said support ball being rotatably supported by said ball bearing for free rotation in all directions.

17. A chair according to claim 16, in which said support ball is of hard plastic material.

18. A chair according to claim 16, in which an upper end portion of said socket is internally threaded and in which said bearing seat comprises a member which is externally threaded and is screwed into said internally threaded upper end portion of said socket, the resulting threaded interconnection of said socket and bearing seat providing accurate positioning of said support ball with respect to said restricted opening of said socket.

19. A chair comprising a circular base plate adapted to rest on a floor and to be movable laterally thereon, a central pivot post projecting up from said base plate and defining a vertical axis of rotation, an upright support column spaced radially from said axis and located near the periphery of said base plate, a telescopically extendible arm connecting said upright support column with said central pivot post for rotation of said arm and upright support column as a unit through an angle of 360° about said vertical axis, a seat mounted at the upper end of said upright support column, and a single rolling support means at the lower end of said upright support column and rolling on said base plate upon rotation of said arm and upright support column about said axis, said arm comprising an outer portion fixed to said upright support column, an inner portion connected with said central pivot post for rotation about said vertical axis but held against rotation about its longitudinal axis and antifriction means between said inner portion and outer portion to provide for free movement of said inner and outer portions relative to one another, said inner and outer portions of said arm being telescopically movable longitudinally relative to one another within predetermined limits for movement of said upright support column and seat toward and away from said axis of rotation but being non-rotatable relative to one another so as to maintain said support column upright, and said rolling support means being rollable in all directions on said base to permit said upright support column and seat to move orbitally about said axis and also to move toward and away from said axis, said upright support column being supported vertically solely by said single rolling support means and being maintained in an upright position by said telescopically extendible arm.

* * * * *